United States Patent [19]

Kaluza

[11] 3,934,548

[45] Jan. 27, 1976

[54] BARREL FOR TREATMENT IN DIPPING BATHS, ESPECIALLY A PLATING BARREL

[75] Inventor: Eduard Kaluza, Im Tuckwinkel, Germany

[73] Assignee: Firma Wilhelm Linnhoff OHG, Muhlenweg, Germany

[22] Filed: Feb. 18, 1975

[21] Appl. No.: 550,718

[30] Foreign Application Priority Data

Feb. 15, 1974 Germany ..... 2407209

[52] U.S. Cl. ..... 118/418; 259/30; 259/81 R

[51] Int. Cl.[2] ..... B05C 3/08

[58] Field of Search ..... 118/418, 419, 19, 303; 427/242; 51/164; 68/210; 259/30, 81 R, 89; 241/176, 179, 180

[56] References Cited

UNITED STATES PATENTS 3,780,545 12/1973 Henderson et al. ..... 68/210

R23,065 12/1948 Ellis ..... 68/210 X

*Primary Examiner*—Morris Kaplan

*Attorney, Agent, or Firm*—Harness, Dickey & Pierce

[57] ABSTRACT

A tumbling drum assembly includes a freely rotatable barrel having an opening in the side thereof and disposed within a driven cage member including a panel closure for said opening. In one direction of cage rotation, the panel is carried to a position to seal said opening and means cooperate to subsequently rotate the barrel. In a reverse direction of cage rotation the panel is carried away from the sealing position and means rotate the barrel in said reverse direction whereby to locate the opening for a discharging operation.

3 Claims, 4 Drawing Figures

1
2
11
12
13
14
21
22
23
24
25

11
14
21
22
23
24
25

I
11
12
15
16
21
22
23
26

11
12
15
16
21
22
23
27

BARREL FOR TREATMENT IN DIPPING BATHS, ESPECIALLY A PLATING BARREL

The invention concerns a barrel for treatment in dipping baths, especially a plating barrel, with a door part which closes the filling and unloading opening of the barrel shell. Known for example is a polygonal plating barrel made of plastic material, where the panels which form the barrel shell are connected with one another by ribs at the corners, and where one panel is formed as a two-parted door with lap joints. The door parts are fixed to the cylinder by toggles. For unloading the barrel the toggle has to be unlocked and the door panels taken away. Those plating barrels are either driven by tooth gears that are situated on the end walls or by a rotating shaft. The task of the invention exists in forming a treatment barrel for automatically locking the filling and unloading opening without the necessity of an extra drive for moving the door part.

A solution of this task of the invention is proposed by a treatment barrel, which is characterized by a reversibly driven barrel cage, situated concentrically on the freely rotatable barrel, whereby the barrel cage drives the barrel when rotating. A shell section of the barrel cage forms the door part of the barrel, which dependent on the direction of revolution of the barrel cage closes or opens the barrel opening. In a favored execution the barrel cage consists of two end walls that are connected by rods parallel to the axis. Between the end walls the door part is fixed. Thereby stop catches on the barrel shell are provided, against which the door part pushes, when the barrel cage rotates, and thus drives the barrel. In accordance with the invention the stop catch on one side of the barrel opening is situated in a position, that when the barrel cage rotates in direction towards this stop catch, the barrel opening is being locked, whereas the second stop catch is in a position that with the opposite direction of revolution of the barrel cage the barrel opening is being opened.

According to the rotating direction of the barrel cage, which drives the barrel, the opening of the treatment barrel is automatically locked or opened.

Figure 1:
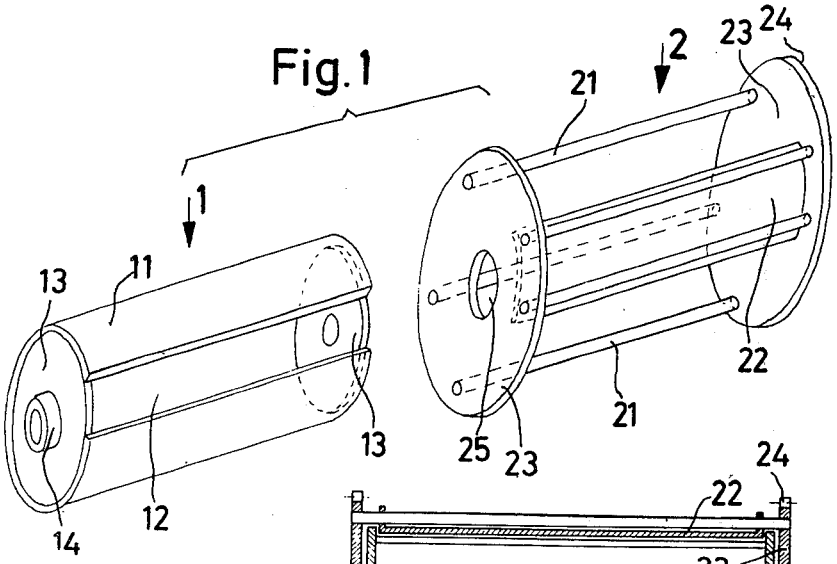
Figure 3:
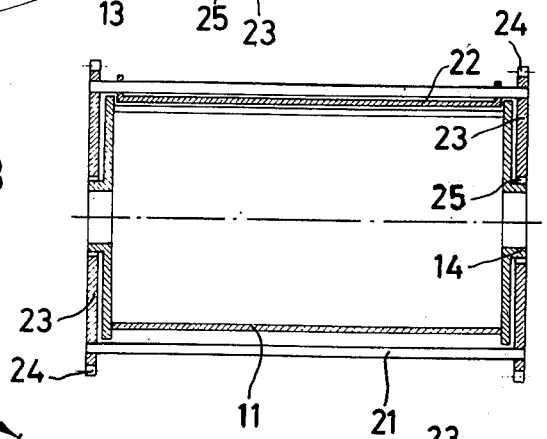
Figure 2:
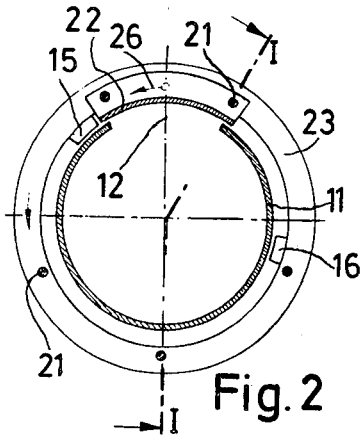
Figure 4:
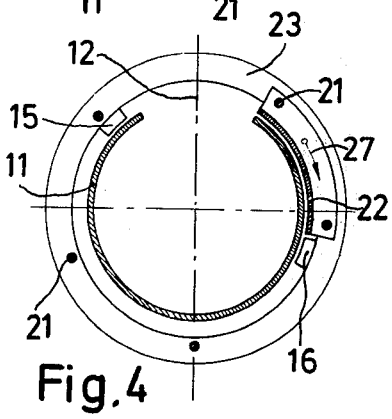

Following an explication of the invention by a principally represented example of the execution. It shows:

FIG. 1 A perspective drawing of the treatment barrel and the barrel cage situated abreast, FIG. 2 A cross-sectional view of the locked barrel, FIG. 3 A cross-sectional view of the line I—I of FIG. 2, and, FIG. 4 A cross-sectional view of the barrel in opened position.

The treatment barrel 1 principally shown in FIG. 1 consists of a barrel shell 11 and both end walls 13. Often plating barrels made of plastic material have a polygonal form. Ribs or connecting rods are situated between the end walls, between the ribs and end walls the panels are fixed, which form the barrel shell. The barrel shell 11 is designed for a filling and unloading opening 12 parallel to the axis. It appeares form the FIGS. 2 and 4 that the treatment barrel 1 is concentrically surrounded by a barrel cage 2. Whereas the barrel cage is driven from outside, the treatment barrel is freely rotatable. The treatment barrel 1 is provided with hollow shaft ends 14 on the end walls 13, which grab into the bores 25 in the end walls 23 of the barrel cage 2. The end walls 23 have a tooth rim 24 and are connected by rods 21 parallel to the axis. Also situated between both end walls 23 is the door part 22 with the form of a section of the barrel shell parallel to the axis. The width of this door part 22 is wider than the filling opening 12 on the barrel shell 1.

When the barrel cage 2 is being driven by the tooth rim 24 of the end walls 23, the door part 22 depending on the direction of revolution strikes against one of the stop catches 15 or 16 on the barrel shell, as can be seen in FIGS. 2 and 4.

With the chosen direction of revolution in FIG. 2 (as indicated by the arrow 26) the door part knocks against the stop catch 15 and locks the barrel opening 12 sufficiently tight, and drives the barrel 1 with its own rotating movement. With this direction of revolution the treatment barrel 1 always stays locked.

When the barrel cage 2 is driven in the opposite direction, as indicated in FIG. 4 with arrows 27, the barrel cage 2 at frist rotates within a certain angular range, that is determined by the stop catches 15 and 16, without influencing the treatment barrel 2. With this movement the door part 22 opens the barrel opening 12 in the barrel shell 11. The treatment barrel is opened. The rotation of the barrel cage after opening the filling and unloading opening 12 may be stopped for example by terminal switches.

There is the possibility of separating the treatment barrel into chambers by one or more partition walls for the treatment of different articles at the same time. According to this execution the door part also may be separated into several different doors.

What is claimed is:

1. A tumbling drum assembly for treating articles by immersion in a fluid medium comprising:

a horizontally arranged, freely rotatable barrel member having an opening in a side portion thereof, whereby to load and unload the barrel with respect to articles to be treated and fluid treating medium, and disposed within a cage member concentric with said barrel;

a panel forming part of and extending between the ends of said cage;

stop elements disposed on said barrel and associated with said opening on each side thereof;

a drive element disposed on said cage and operatively associated with said stop elements; and means to reversably rotate said cage; whereby in one direction of cage rotation said panel is carried to a sealing relationship with respect to said opening and simultaneously therewith said drive element engages one of said stop elements and on further rotation in said one direction the barrel is rotated whereby to tumble the barrel contents, and in a subsequent other direction of cage rotation the panel is removed from opening, the drive element engages the other of said stop elements and the barrel is subsequently rotated in a reverse direction whereby to locate said opening in an unloading position.

2. A tumbling drum assembly as in claim 1 wherein said stop elements are disposed on the side structure of the barrel and the edges of said panel are adapted to contact said stops and comprise said drive element.

3. A tumbling drum assembly as in claim 1 wherein said stop elements are disposed on an end surface of said barrel and said drive element is disposed on a corresponding end of said cage.

* * * * *